US009486385B1

(12) United States Patent
Terrill

(10) Patent No.: US 9,486,385 B1
(45) Date of Patent: Nov. 8, 2016

(54) COMPACT CANTILEVERED AMBULATORY ASSISTIVE DEVICE

(71) Applicant: Rufus Ondy Terrill, Atlanta, GA (US)

(72) Inventor: Rufus Ondy Terrill, Atlanta, GA (US)

( * ) Notice: Subject to any disclaimer, the term of this patent is extended or adjusted under 35 U.S.C. 154(b) by 0 days.

(21) Appl. No.: 14/961,852

(22) Filed: Dec. 7, 2015

Related U.S. Application Data

(60) Provisional application No. 62/091,587, filed on Dec. 14, 2014.

(51) Int. Cl.
*A61H 3/04* (2006.01)
*A61H 3/00* (2006.01)

(52) U.S. Cl.
CPC ..... *A61H 3/04* (2013.01); *A61H 2003/006* (2013.01); *A61H 2003/046* (2013.01)

(58) Field of Classification Search
CPC ..... B62B 3/00; B62B 3/02; B62B 3/10
See application file for complete search history.

(56) References Cited

U.S. PATENT DOCUMENTS 4,757,992 A * 7/1988 Heitsch ..... A63B 23/1245 482/100
4,817,943 A * 4/1989 Pipasik ..... A63B 21/0615 482/137
4,949,951 A * 8/1990 Deola ..... A63B 21/154 482/100
8,402,576 B2 * 3/2013 Walker ..... A61G 7/1051 5/83.1
9,248,063 B2 * 2/2016 Wang ..... A61G 7/1003
2011/0126351 A1 * 6/2011 Walker ..... A61G 7/1051 5/87.1

* cited by examiner

*Primary Examiner* — John Walters
*Assistant Examiner* — James Triggs

(57) ABSTRACT

The Compact Cantilevered Ambulatory Assistive Device is intended to give physical support to persons having diminished abilities to walk, stand from a sitting position or to be seated from a standing position or maintain their balance. The design of the Compact Cantilevered Ambulatory Assistive Device supplies an upward force to the user through the Elongated Cantilevered Handles when transitioning from a sitting position to standing and provides stable support to the user when going from standing to a sitting position. The device maintains a stable support for the user by keeping the center of gravity of the device below the center of mass of the user, while walking, standing or transitioning from standing to sitting or from sitting to standing through the incorporation of cantilevered multi-wheeled bogie assemblies with the of the device's vertical support frames, the bogie assembly wheels being of such small diameters as to move without impediment under obstructions such as furniture, fixtures or seating.

10 Claims, 14 Drawing Sheets

COMPACT CANTILEVERED AMBULATORY ASSISTIVE DEVICE

CROSS REFERENCE

Figure 1:
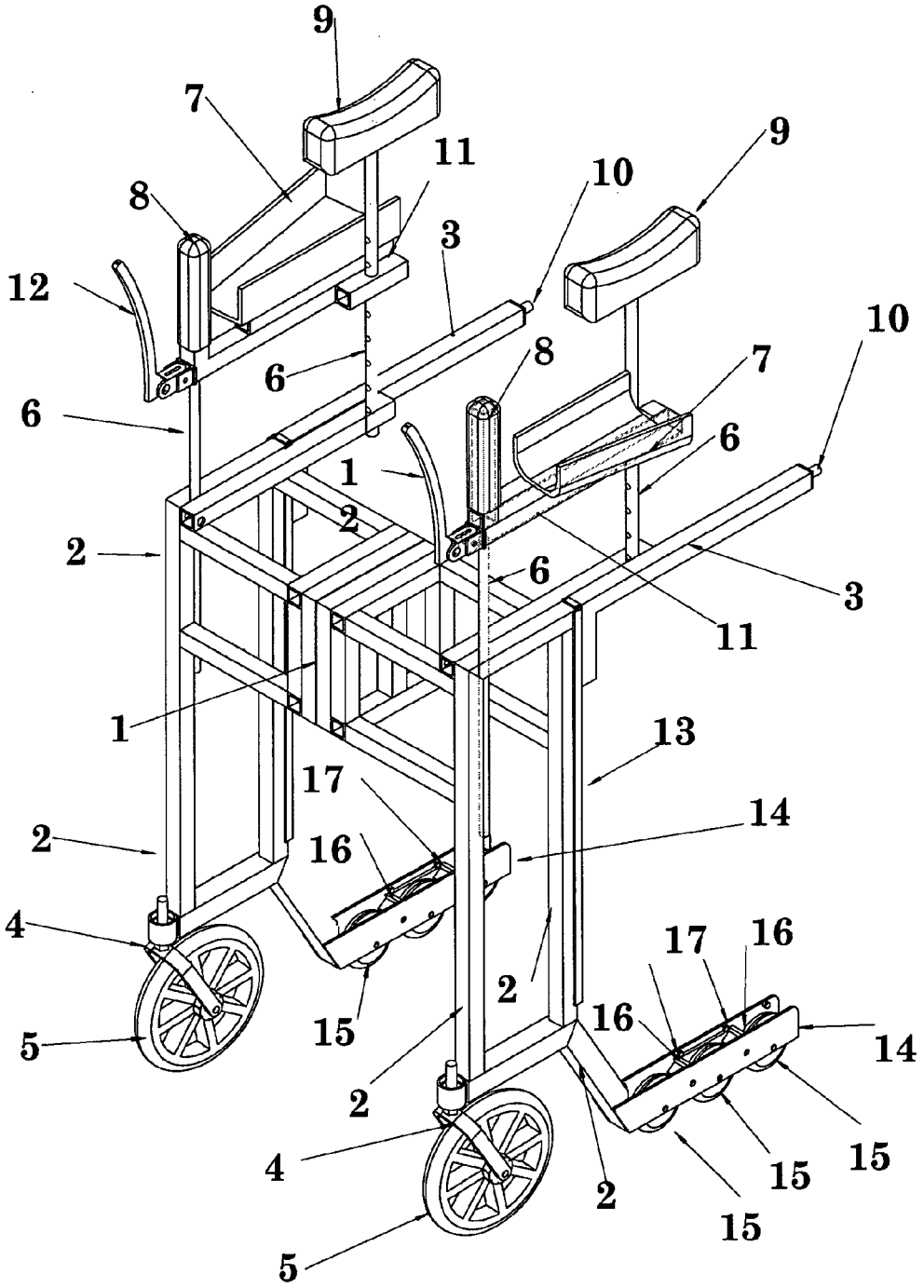

This application is filed relating to the earlier filed provisional Application No. 62/091,587

STATEMENT REGARDING FEDERALLY SPONSORED RESEARCH OR DEVELOPMENT

Funding for this invention is paid 100% by the inventor's personal assets.

No federal funds were used in the research and or development of this invention.

BACKGROUND OF THE INVENTION

Assistive aids for persons with reduced abilities to walk are found in many growing markets. These conventional walkers and rolling walkers utilized by many require the user to be in the standing position before the walker's physical support can be transmitted to the user by holding on to the walker by griping the sides of the walker. For persons with limited mobility, the act of standing from a sitting position is often a strenuous process, requiring the individual to pull himself up by grasping a stationary support above his sitting location or the individual must push himself up by applying a downward force on the furniture or object on which he is seated.

The prior art of assistive walking devices, going back to S. A. Darrach's, Improvement in Wheel-Crutches or Perambulators, U.S. Pat. No. 130,283, August, 1872 required the user to be in an upright standing position in order to place themselves in contact with the device's support. The introduction of a supporting seat with N. G. Bowser's, Combination Wheeled Chair and Crutch, U.S. Pat. No. 2,129,260, January, 1937 and the addition of swivel wheels by A. Comper's, Invalid Walker Unit, U.S. Pat. No. 112,691, June, 1938 aided in the support of the user but did not negate the necessity of reaching a standing position in order to gain support of the device.

Additional improvements in assistive walking devices include a crutch support with wheels as added by K. Schwartz's, Walkers' Aids, U.S. Pat. No. 2,843,180, July 1958, and improved handle supports and swivel wheels as introduced by Breyley's, Walking Aid, U.S. Pat. No. 4,046, 374, September, 1977

One of the most recognized assistive devices is based on Thomas', Invalid Walker Apparatus U.S. Pat. No. 4,135,535, January, 1979, which incorporates circular bracing to increase strength and allows the user to receive support by grasping handles along sides of the device. Although innovative, this device also required the user to be in the standing position to receive support.

The addition of a foot brake to a wheeled walker with crutch supports and handles by Daughtery, Wheeled Mounted Walker with Foot Pedal Brake, U.S. Pat. No. 4,226,413, October, 1980 added to the functionality of assistive devices for users who were in the standing position.

Wheeled assistive devices continued to evolve with improvements such as a tricycle wheel placement including brake pads on multiple wheels as in Tuberville's, Walker Having Wheels and Brakes, U.S. Pat. No. 5,020,560, June, 1991 and gained further refinements with the addition of a user worn harness which supported the user as in Hoffman's, Handless Walking Aid for Preventing Falls From Loss of Balance, U.S. Pat. No. 5,152,730, October, 1992. With the advent of the ability to more easily transport and use assistive devices such as in Miller's, Foldable Walking Stabilizer Device For Physically Disabled Persons, U.S. Pat. No. 5,538,268, July, 1996 and improved handle arrangements and support Seating as in Mullholand's, Assistive Walking Device, U.S. Pat. No. 7,275,554 B2, October, 2007, the use of assistive devices has grown dramatically.

While these assistive devices are innovative in their support for the user, the user must to be in the standing position to gain support from these devices and the devices do not assist the user in reaching a standing position.

Helping the user transition between a sitting and standing position was addressed with a wheeled support and lifting sling in J. A. Rupprecht's, Walker Mechanism for Invalids, U.S. Pat. No. 2,327,671, August, 1943. This process was advanced with a refined lifting crutch and support handles in R. A. Benoit's, Invalid Lifting and Support Device, U.S. Pat. No. 3,394,933, July, 1968.

Various approaches are used to transition the user between the sitting and standing position. Fortner's, Standing Lift and Support For Wheelchair User, U.S. Pat. No. 4,948,156, August 1990 is a wheelchair apparatus which restricted forward movement of the user's knees and hips and enables the user to pull himself to the standing position by grasping a bar, moved into position by a worm gear mechanism. A refinement of this approach is Workman's, Method and System for Concentrated Primary Support for a User In Support Assistive Devices, U.S. Pat. No. 6,343,802 B2, February, 2002, which utilized a harness strapped around the user's abdomen to provide support in transition between standing and sitting postures.

Later innovations in lifting and seated support for users were introduced by Gutierrez's, Dynamic Seating and Walking Wheelchair, U.S. Pat. No. 6,619,681 B2, September, 2003 and by Razon's, Adjustable Leg Support and Seated to Stand Up Walker, U.S. Pat. No. 6,733,018 B2, May, 2004, which incorporates a hydraulic powered lifting sling to assist the user between sitting and standing.

The combined prior art of assistive devices provides stability for the user when the user is in a standing position or assists in lifting the user to a standing position or lower the user to a sitting position but, does not address the need for an assistive device that performs both the task of stable ambulatory support and assistance transitioning between sitting and standing.

SUMMARY OF THE INVENTION

This Compact Cantilevered Ambulatory Assistive Device, incorporates a stable platform which supports the user while he is standing or walking and supports the user during the transition from standing to sitting and from sitting to a standing position. Persons often have greatly reduced upper body strength in situations where they are pulling themselves in an upward direction. The same individuals can exert greater force in pushing down against a solid surface on which they are seated. This observation has been integrated into the development of the Compact Cantilevered Ambulatory Assistive Device so that it provides the user with stable support during the act of standing and during the act of sitting by maintaining the device's center of gravity under the center of mass of the user, furthermore the device provides a direct upward force through the device's Elongated Cantilevered Handles thereby reducing the physical strength needed by the user to raise up to the standing position from a seated posture while the user maintains contact with the Elongated Cantilevered Handles, additionally the user receives stability during the transitioning from standing to sitting by providing resistance in the vertical direction as the Elongated Cantilevered Handles move in a downward direction, furthermore the device provides the user with stable support in the standing position and aids in the act of walking.

BRIEF DESCRIPTION OF THE SEVERAL VIEW OF THE DRAWINGS

FIG. 1: Compact Cantilevered Ambulatory Assistive Device, Front Isometric View, Right and Left Vertical Support Frame Assemblies in union FIG. 2: Compact Cantilevered Ambulatory Assistive Device Assembly, Rear Isometric View, Right and Left Vertical Support Frame Assemblies in union FIG. 3: Compact Cantilevered Ambulatory Assistive Device, Rear Isometric View, Right Vertical Support Frame Assembly, Elongated Cantilevered Handle within Elongated Handle Guides and located in the Top locked Position on frame assembly FIG. 4: Compact Cantilevered Ambulatory Assistive Device, Rear Isometric View, Right Vertical Support Frame Assembly, Elongated Cantilevered Handle within Handle Guides and located in a Lower locked Position in the Vertical Support Frame Assembly FIG. 5: Compact Cantilevered Ambulatory Assistive Device, Rear Isometric View, Swivel Guide Wheel Assembly, lower Vertical Support Frame Assembly and Cantilevered Bogie Assembly FIG. 6: Compact Cantilevered Ambulatory Assistive Device, Rear Isometric View, Cantilevered Bogie Assembly FIG. 7: Compact Cantilevered Ambulatory Assistive Device, Rear Isometric View, Cantilevered Bogie Assembly parts details FIG. 8: Compact Cantilevered Ambulatory Assistive Device, Side View with User in Supported Walking Position FIG. 9: Compact Cantilevered Ambulatory Assistive Device, Front Isometric View, User in Supported Walking Position FIG. 10: Compact Cantilevered Ambulatory Assistive Device, Side View with User in Supported Standing Position FIG. 11: Compact Cantilevered Ambulatory Assistive Device, Front Isometric View, User in Supported Standing Position FIG. 12: Compact Cantilevered Ambulatory Assistive Device, Side View with User in Supported Sitting Position FIG. 13: Compact Cantilevered Ambulatory Assistive Device, Side View with User in Supported Sitting Position on Representative Chair FIG. 14: Compact Cantilevered Ambulatory Assistive Device, Front Isometric View, User in Supported Sitting Position on. Representative Chair

REFERENCE NUMERALS IN THE DRAWINGS

1. Central Pivoting Suspension Bearing
2. Vertical Support Frame Assembly
3. Elongated Cantilevered Handle
4. Swivel Guide Wheel Assembly
5. Guide Wheel
6. Height Adjustment Rod
7. Horizontal Forearm Support
8. Vertical Handle
9. Shoulder Concaved Support Rest
10. Elongated Cantilevered Handle Release
11. Vertical Handle Support Frame Assembly
12. Brake Handle Assembly
13. Elongated Handle Guides
14. Cantilevered Bogie Assembly
15. Bogie Assembly Wheel
16. Bogie Assembly Brake Pad
17. Bogie Assembly Brake Linkage
18. Representative Chair or Piece of Furniture

DETAILED DESCRIPTION OF THE INVENTION

FIG. 1: Shows the Compact Cantilevered Ambulatory Assistive Device in a Front Isometric View. The Right and Left Vertical Frame Assembly (2) in union with Elongated Cantilevered Handle (3) in the upper locked position within the Elongated Handle Guides (13) of Vertical Support Frame Assembly (2) and reference numerals for the major inclusions of the device.

a) The Compact Cantilevered Ambulatory Assistive Device is an apparatus being comprised of a right hand and a left hand Vertical Support Frame Assembly (2) being held in union through the force of a Central Pivoting Suspension Bearing (1). Each Vertical Support Frame Assembly (2) being comprised of a rectangular structure having parallel and vertical struts joined as to provide an elevated platform with restrictive side access, partial front access and open rear access, further having an Elongated Cantilevered Handle (3) coincident to the rear face of the Vertical Support Frame (2) and movable in the vertical plane and being in parallel alignment with the apex of the Vertical Support Frame (2) Furthermore, the Elongated Cantilevered Handle (3) having a locking apparatus within its structure being engaged or released by actuating the Elongated Cantilevered Handle Release (10) thus permitting movement of the Elongated Cantilevered Handle (3) in a positive or negative vertical direction.

The Elongated Cantilevered Handle (3) is mechanically linked to its vertical frame assemble by a mechanism providing force in the upward vertical direction, this mechanism being similar to a spring.

b) Furthermore, the bottom forward face of each Vertical Support Frame Assembly (2) having attached a Swivel Wheel Assembly (4) with a vertical axis offset from the axis of rotation of the Guide Wheel (5). Further, the bottom rear face of the Vertical Support Frame Assembly (2) being joined with a Cantilevered Bogie Assembly (14). The Cantilevered Bogie Assembly (14) being comprised of multiple Bogie Assembly Wheels (15), Multiple Bogie Assembly Brake Pads (16) and Bogie Assembly Brake Linkages (17). Further the Bogie Assembly Wheels (15) having diameters which permits the Cantilevered Bogie Assembly (14) to be positioned under structures, furniture and seating as the User may necessitate.

c) Furthermore, the apex of the Vertical Support Frame Assembly (2) having vertical linear bearing surfaces for retaining and permitting changes in elevation of Height Adjustment Rods (6). The Height Adjustment Rods (6) being supports for the Vertical Handle Support Frame Assembly (11), Vertical Handle (8), Brake Handle Assembly (12), Horizontal Forearm Support (7) and Shoulder Concaved Support Rest (9)

Figure 2:
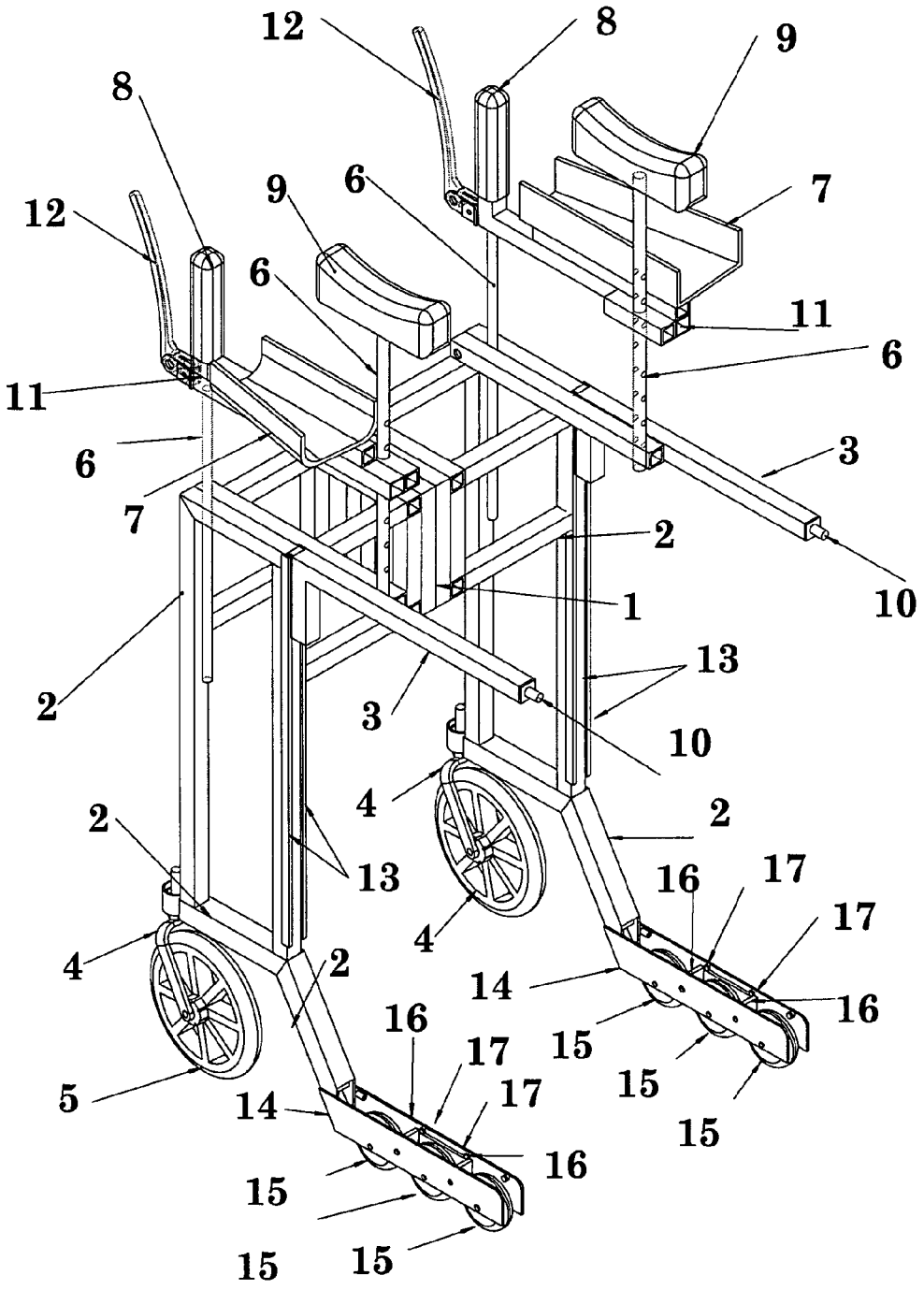

FIG. 2: Shows the Compact Cantilevered Ambulatory Assistive Device in a Rear Isometric View. The Right and Left Vertical Support Frame Assemblies (2) in union with Elongated Cantilevered Handle (3) in the upper locked position within the Elongated Handle Guides (13) of Vertical Support Frame Assembly (2) and reference numerals for the major inclusions of the device as described in FIG. 1.

a) Furthermore, the user can apply pressure to the Brake Handle Assembly (12) comprising each Vertical Support Frame Assembly (2) through cabling, activating the Bogie Assembly Brake Linkage (17) concurrently forcing the Bogie Assembly Brake Pads (16) to apply friction to the Bogie Assembly Wheels (15).

b) By varying the level of friction applied the Bogie Assembly Wheels (15) comprising the Cantilevered Bogie Assembly (14) of each Vertical Support Frame Assembly (2) forward and reward motion of the Compact Cantilevered Ambulatory Assistive Device can be halted or the direction of the Compact Cantilevered Ambulatory Assistive Device can be altered.

Figure 3:
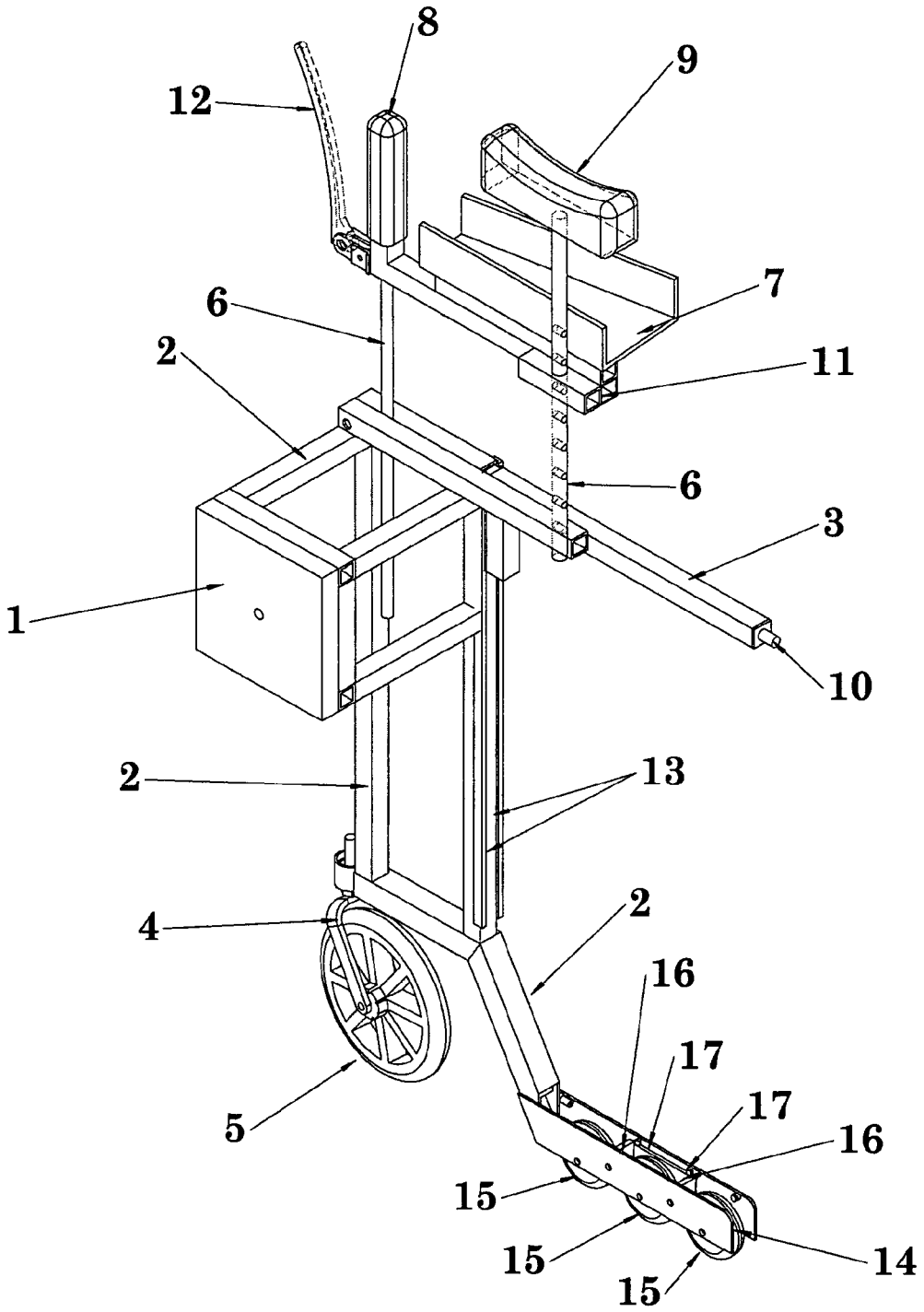

FIG. 3: Shows the Compact Cantilevered Ambulatory Assistive Device, in a Rear Isometric View of only the Right Vertical Support Frame Assembly (2), Elongated Cantilevered Handle (3) in the upper locked position within the Elongated Handle Guides (13) of the Vertical Support Frame Assembly (2) and reference numerals for the major inclusions of the device.

Figure 4:
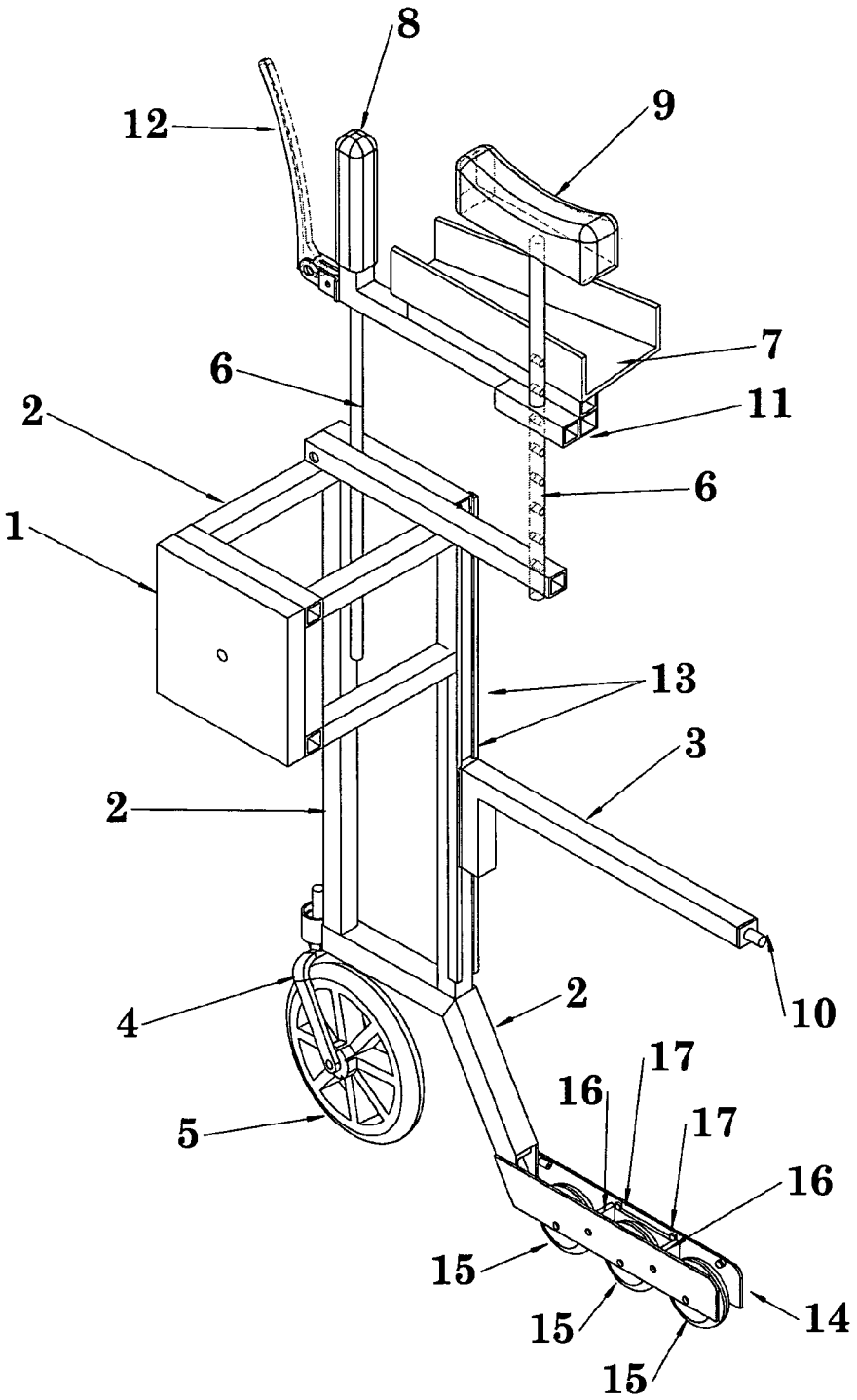

FIG. 4: Shows the Compact Cantilevered Ambulatory Assistive Device, in a Rear Isometric View of only the Right Vertical Support Frame Assembly (2), Elongated Cantilevered Handle (3) in a lower locked position within Elongated Handle Guides (13) of the Vertical Support Frame Assembly (2) and reference numerals for the major inclusions of the device.

Figure 5:
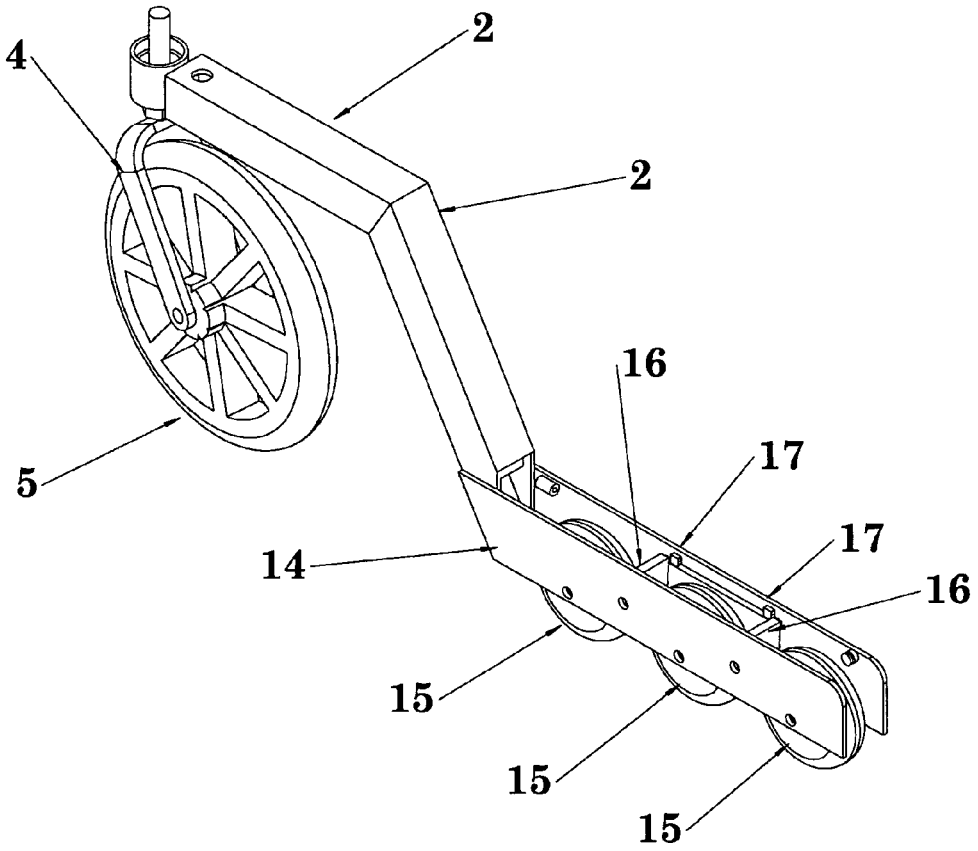

FIG. 5: Shows the Compact Cantilevered Ambulatory Assistive Device, in a Rear Isometric View of the lower portion of the right Vertical Support Frame Assembly (2), Swivel Guide Wheel Assembly (4), Guide Wheel (5) lower and Cantilevered Bogie Assembly (14) including Bogie Assembly Wheels (15), Bogie Assembly Brake Linkages (17), Bogie Assembly Brake Pads (16)

Figure 6:
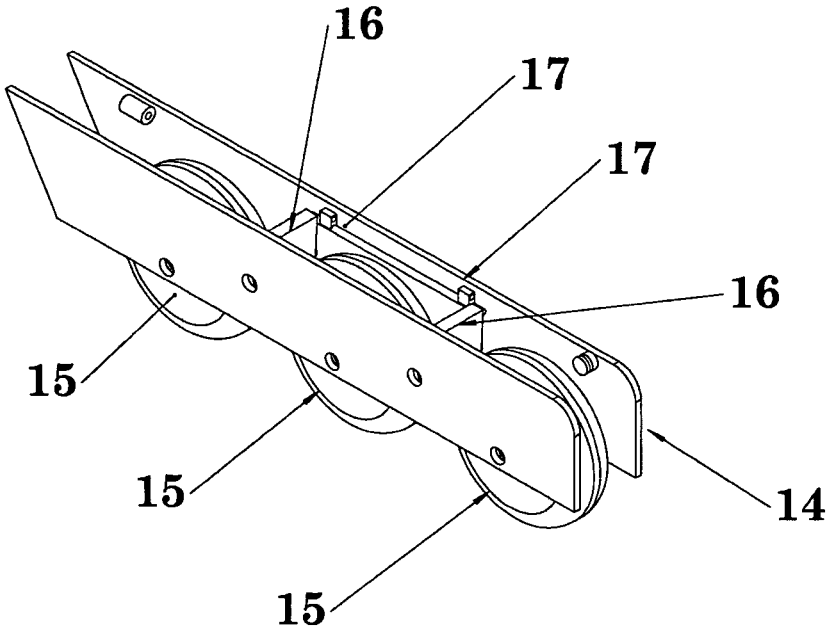

FIG. 6: Shows the Compact Cantilevered Ambulatory Assistive Device, in a Rear Isometric View of the right Cantilevered Bogie Assembly (14) including Bogie Assembly Wheels (15), Bogie Assembly Brake Linkages (17), Bogie Assembly Brake Pads (16)

Figure 7:
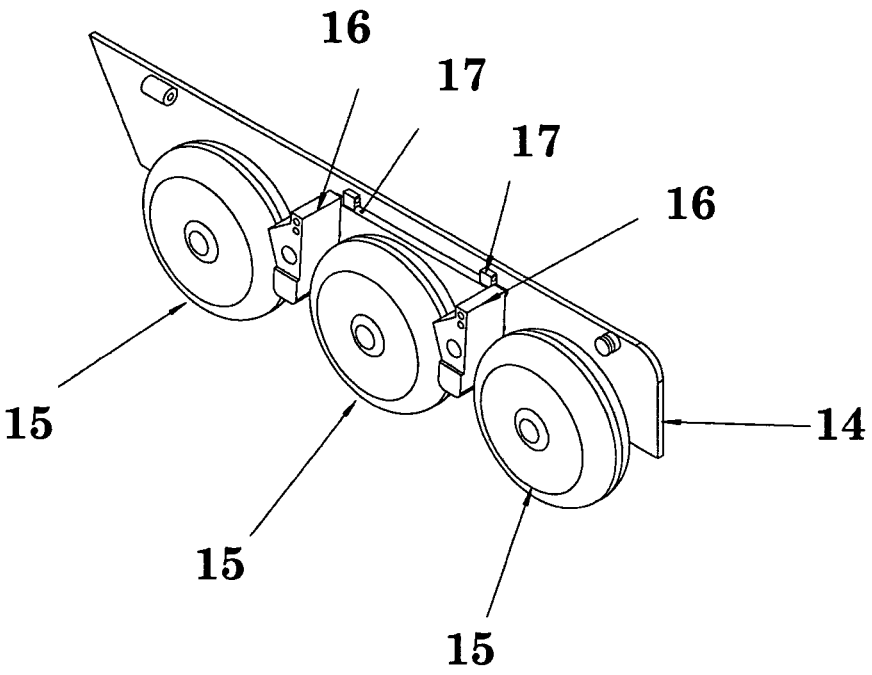

FIG. 7: Shows the Compact Cantilevered Ambulatory Assistive Device, in a Rear Isometric Open Frame View, of the right Cantilevered Bogie Assembly (14) including Bogie Assembly Wheels (15), Bogie Assembly Brake Linkages (17), Bogie Assembly Brake Pads (16)

Figure 8:
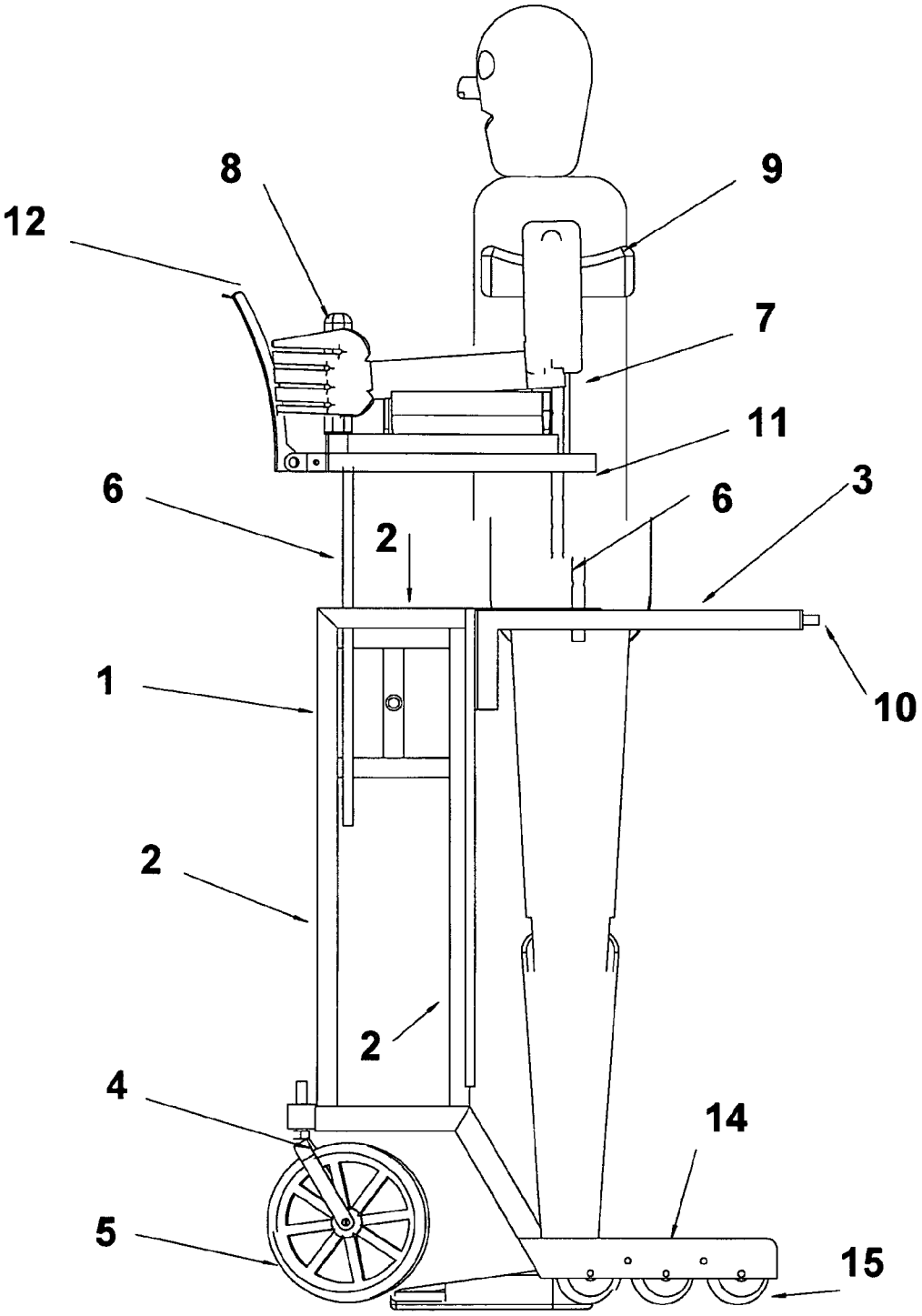
Figure 9:
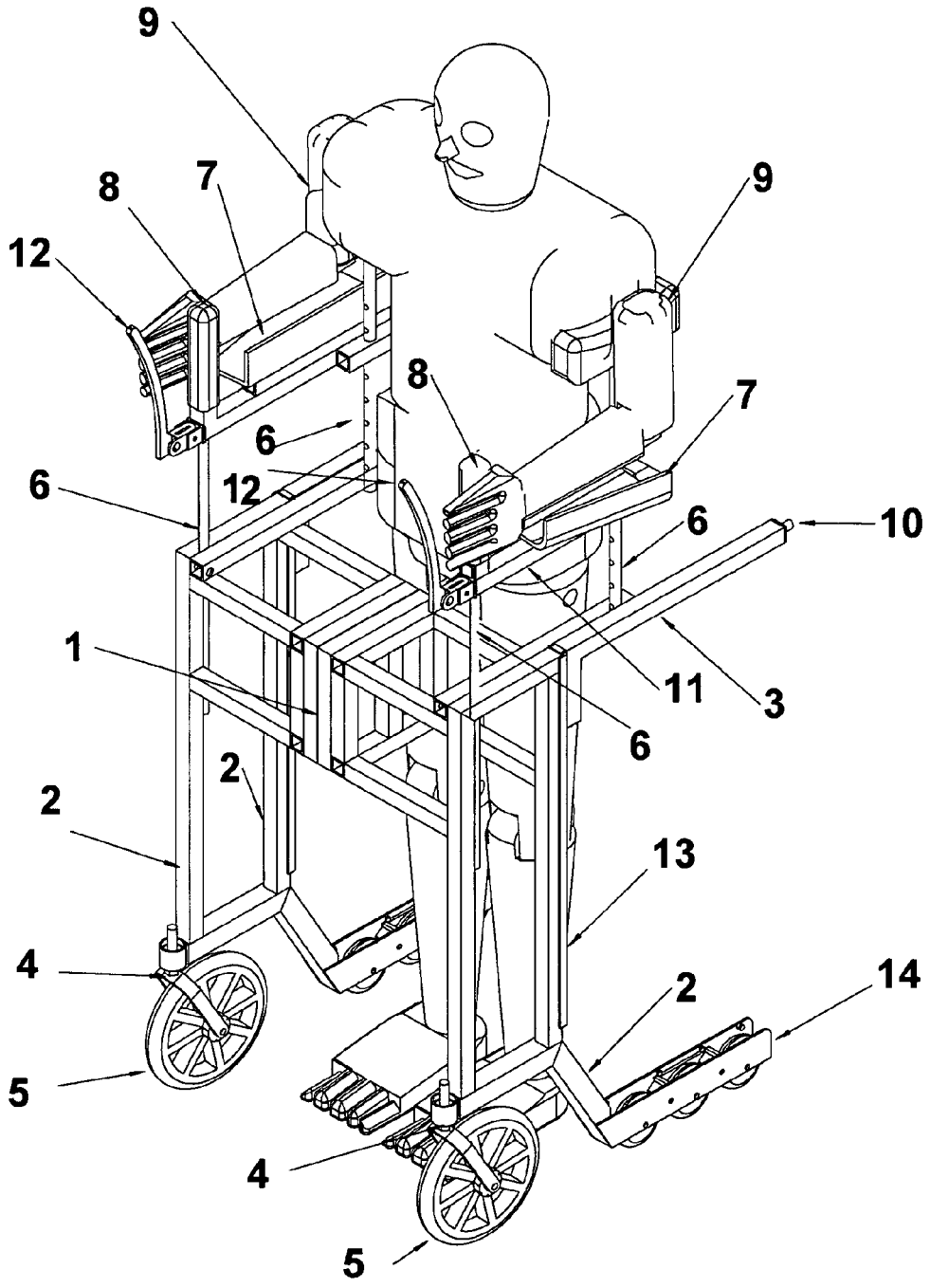

FIG. 8 and FIG. 9: Show the Compact Cantilevered Ambulatory Assistive Device in a Side View and Front Isometric View with the User in a Supported Walking Position with the Elongated Cantilevered Handle (3) on each Vertical Support Frame Assembly (2) in its upper locked position and parallel to the Cantilevered Bogie Assembly (14).

a) The user is supported in the Axilla, Anterior and Posterior Axillary Fossa by the Shoulder Concaved Support Rest (9) further the user is griping the Vertical Handle (8) and the User's forearm is applying downward force on the Horizontal Forearm Support (7) which is mounted coincident to the Vertical Handle Support Frame Assembly (11) giving the user physical support along the user's Anconeus, Extensor Digiti-minimi, Extensor Carpi Ulnaris, Flexor Carpi Ulnaris and Ulnar Crest.

b) With the user in contact with the Compact Cantilevered Ambulatory Assistive Device as described, a portion of the User's mass is supported vertically reducing stress on the User's feet and legs. Concurrently the User receives support in the vertical, Yaw axis, in the lateral, Pitch axis and in the longitudinal, Roll axis.

c) While the User is supported by the Compact Cantilevered Ambulatory Assistive Device the User can ambulate in a forward progression or in a rearward progression and make changes in direction by the rotation his upper body in the Transverse Plane, there by varying the angle of Yaw through the modification of the vertical axis of the Swivel Guide Wheel Assembly (4) which intern changes the rotational axis of the Guide Wheel (5). While in contact with the Compact Cantilevered Ambulatory Assistive Device the User has the option of applying pressure to Brake Handle Assembly (12) comprising each Vertical Support Frame Assembly (2) through cabling, activating the Bogie Assembly Brake Linkage (17) concurrently forcing the Bogie Assembly Brake Pads (16) to apply friction to the Bogie Assembly Wheels (15).

d) By varying the level of friction applied the Bogie Assembly Wheels (15) comprising the Cantilevered Bogie Assembly (14) of each Vertical Support Frame Assembly (2) forward and reward motion of the Compact Cantilevered Ambulatory Assistive Device can be halted or the direction of the Compact Cantilevered Ambulatory Assistive Device can be altered.

Figure 10:
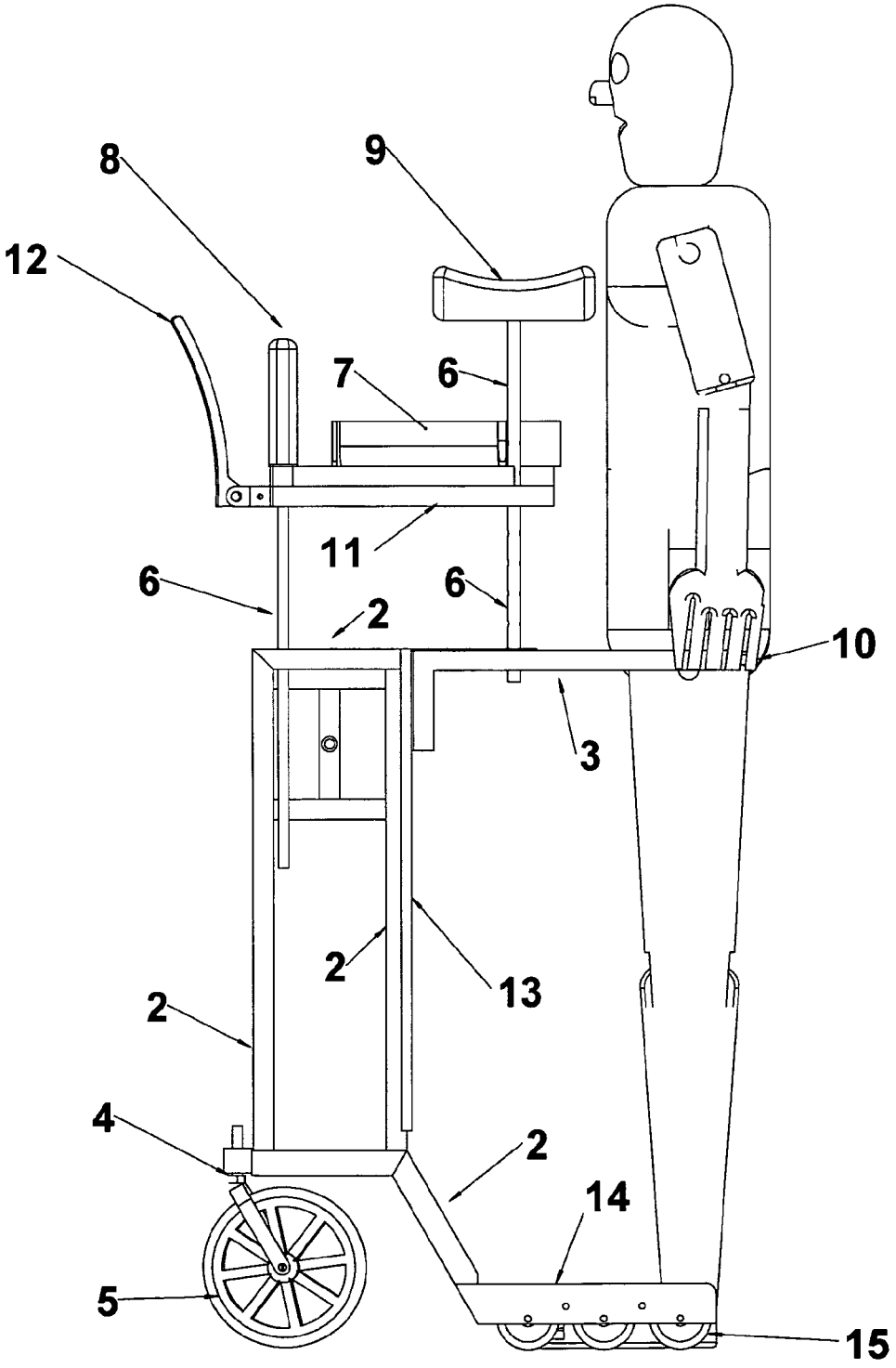
Figure 11:
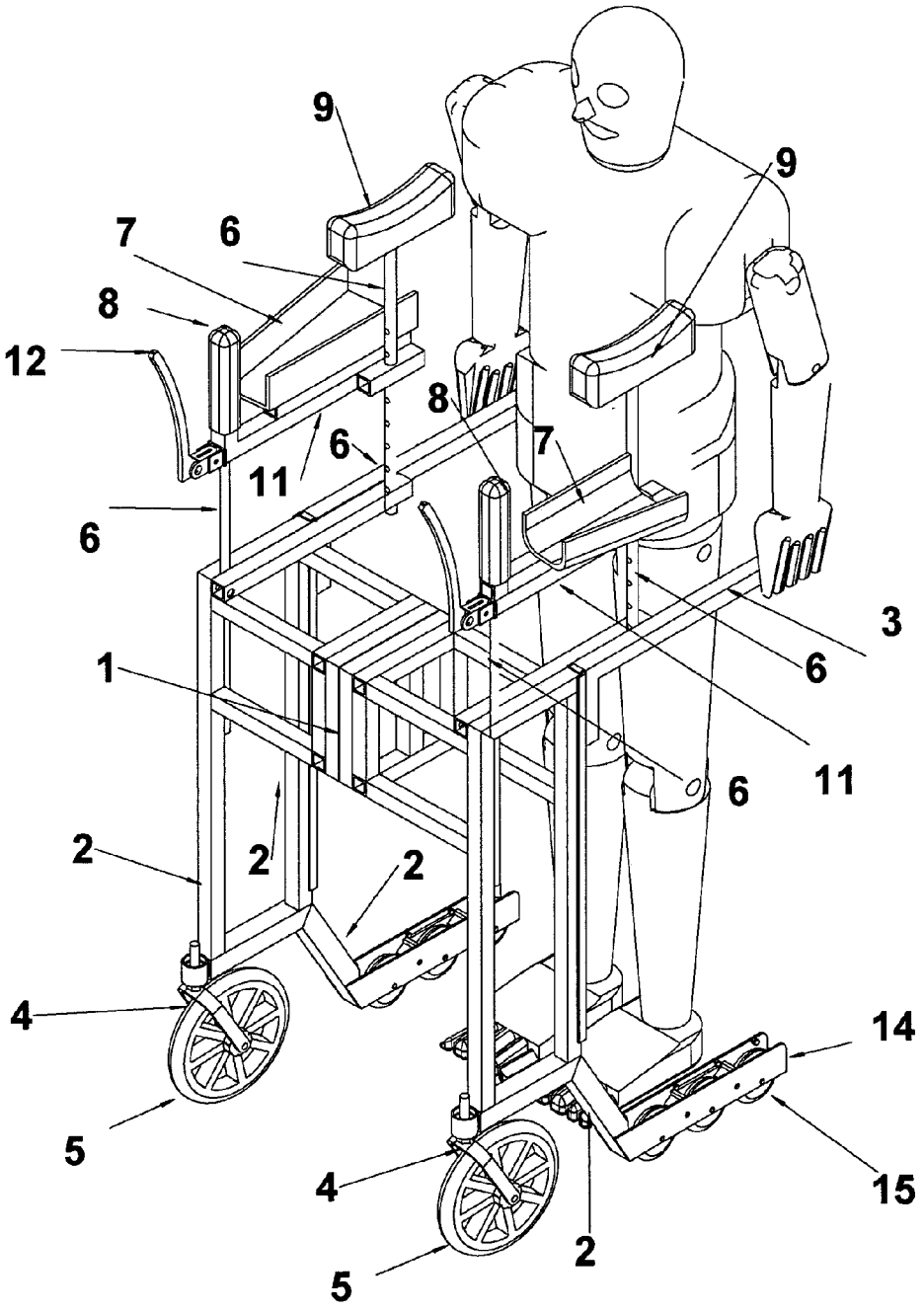

FIG. 10 and FIG. 11: Show the Compact Cantilevered Ambulatory Assistive Device in a Side View and Front Isometric View with the User in a Supported Standing Position. With the Elongated Cantilevered Handle (3) on each Vertical Support Frame Assembly (2) in its upper locked position parallel to the Cantilevered Bogie Assembly (14) the center of gravity of the Compact Cantilevered Ambulatory Assistive Device is maintained under the center of mass of the user in the standing position.

Figure 12:
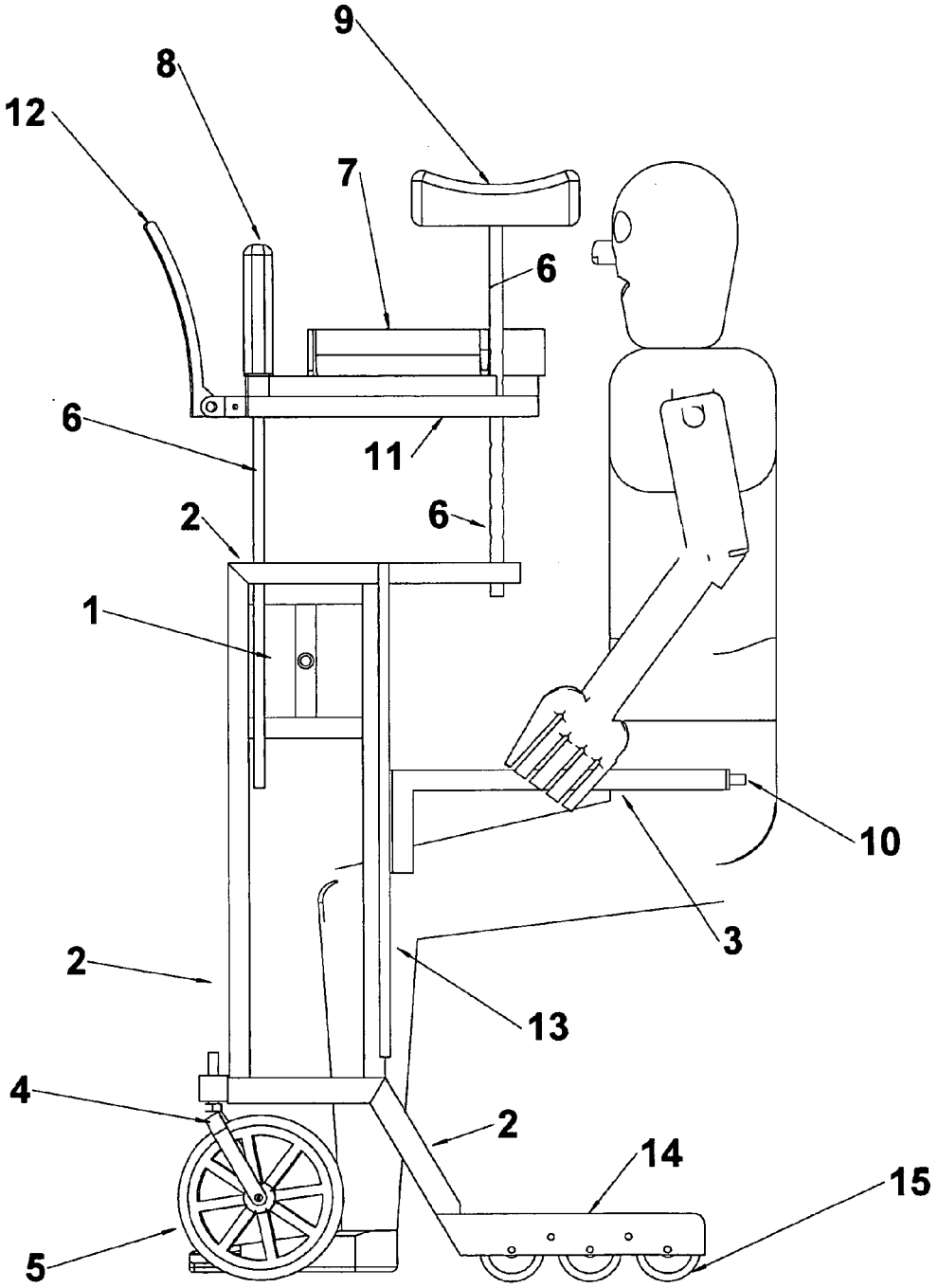
Figure 13:
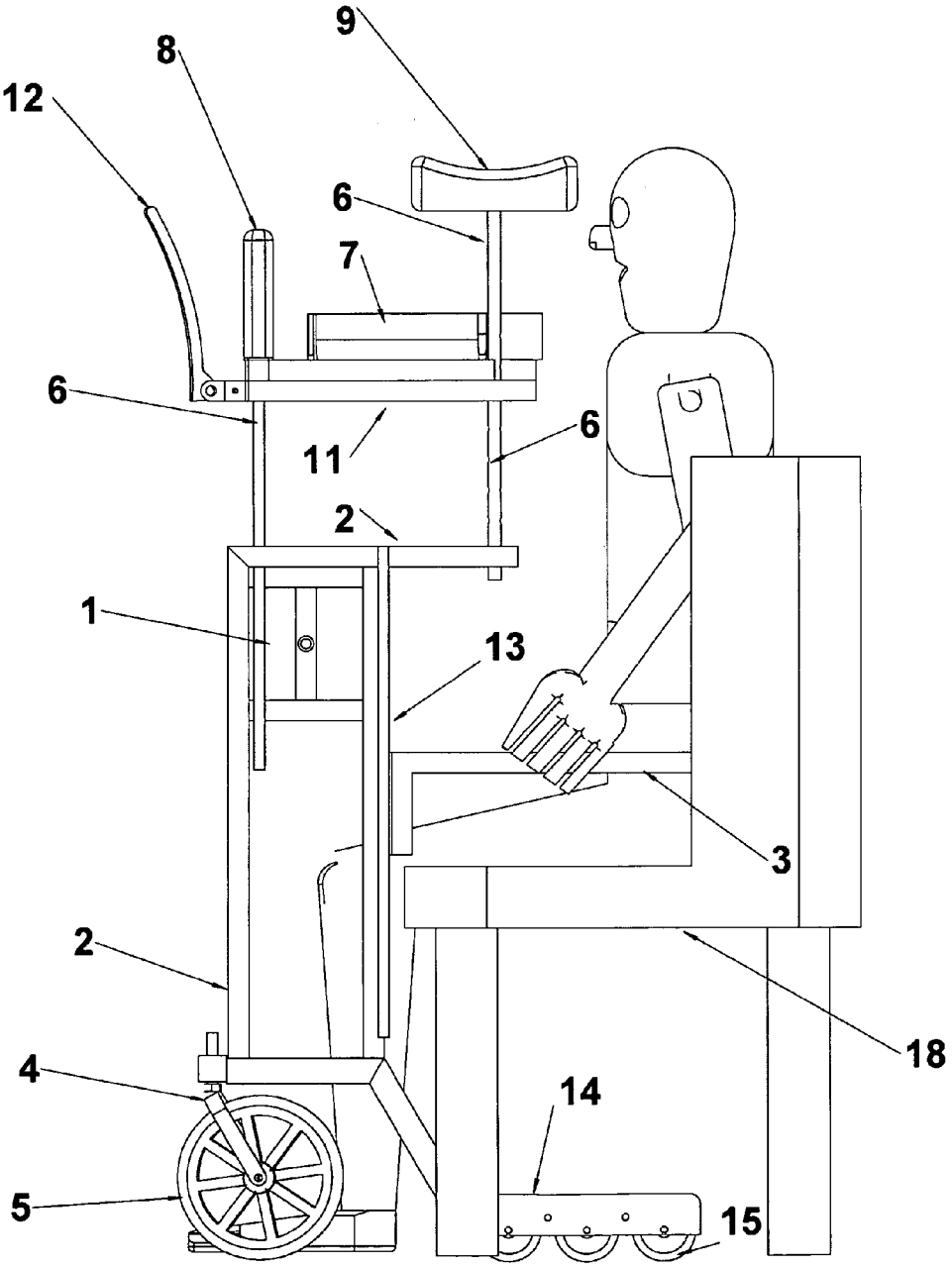
Figure 14:
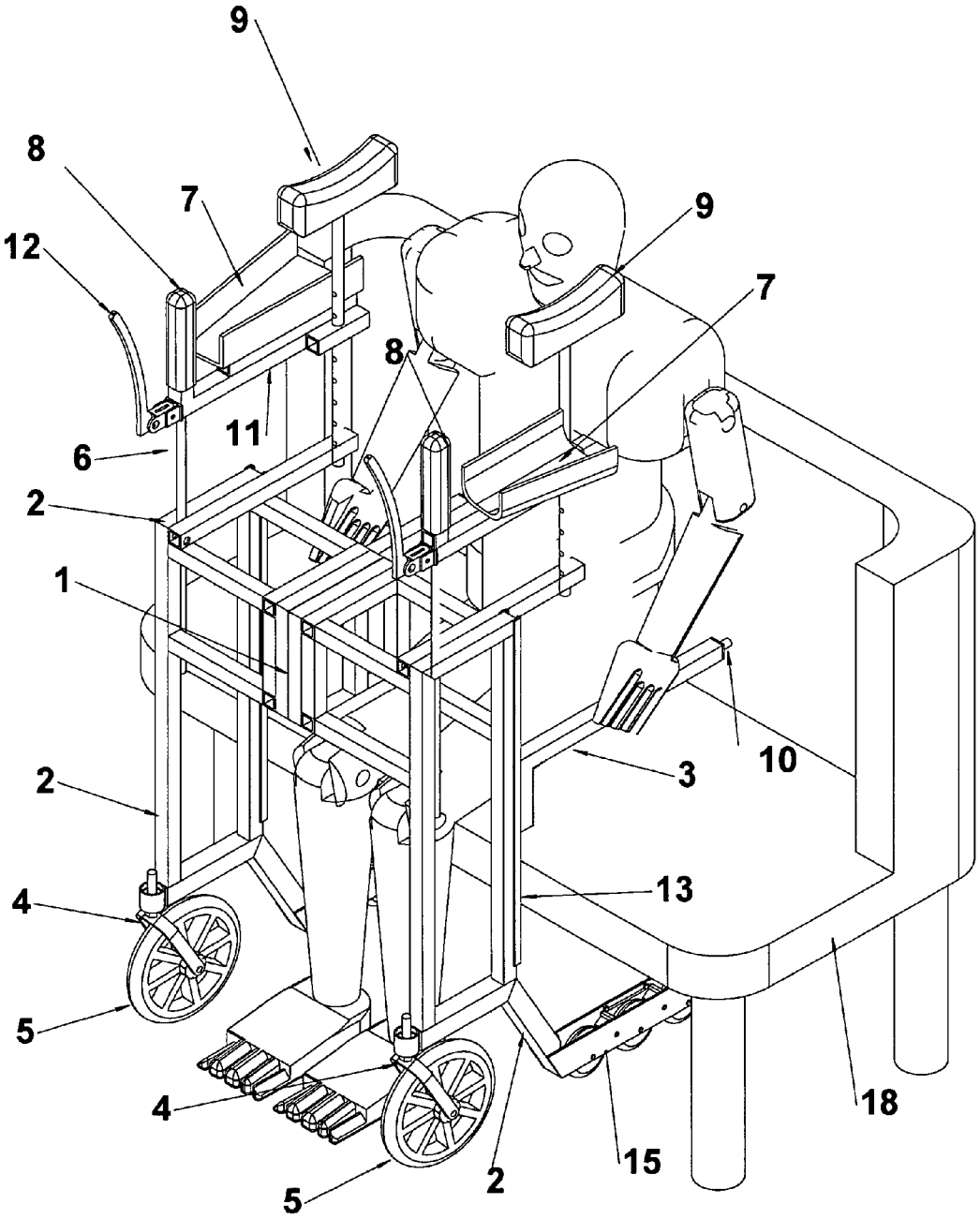

FIG. 12: Shows the Compact Cantilevered Ambulatory Assistive Device in a side view wherein the Elongated Cantilevered Handle (3) is used as a physical support base, from which the User maintains stability in transition from standing to a sitting position by applying variable downward force on the Elongated Cantilevered Handle (3) of each Vertical Support Frame Assembly (2) as the user descends to the sitting position. Concurrently the center of gravity of the device is maintained under the center of mass of the user as a corollary of the Cantilevered Bogie Assembly (14) position being fixed under the Elongated Cantilevered Handle (3) of each Vertical Support Frame Assembly (2) and the user maintaining contact with the Elongated Cantilevered Handle (3) during the natural rearward positioning of the user's mass in being seated from a standing position. FIG. 13 and FIG. 14: Shows the Compact Cantilevered Ambulatory Assistive Device in a Side View and Front Isometric View with the User in a Supported Sitting Position on a representative chair or piece of furniture (18).

a) The Elongated Cantilevered Handle (3) on each Vertical Support Frame Assembly (2) is in a lower locked position. With the Elongated Cantilevered Handle (3) on each Vertical Support Frame Assembly (2) locked in a lower position, the Elongated Cantilevered Handle (3) is used as a physical support base, from which the user can push down against the Elongated Cantilevered Handle (3) to transition up from the sitting position to a standing position.

b) The center of gravity of the device is maintained under the user owing to the Cantilevered Bogie Assembly (14) having sufficient clearance between base of the furniture (18) and the rolling surface to move under the centerline of mass of the user as the user transitions from standing to sitting positions and sitting to standing positions.

The invention claimed is:

1. An assistive device, utilized by a user having diminished abilities to walk, stand, maintain balance while standing or during the act of sitting or standing, comprising:

a) a right hand and a left hand structure;

b) where in the left and right hand structure held in union with a bearing surface so as to provide rotational movement around the common longitudinal axis of the right hand and left hand structures;

c) the right hand and left hand structures having horizontal and vertical struts as to provide an elevated platform with restrictive side access, partial front access and open rear access;

d) a mechanism coincident to the rear face of the right hand and left hand structures being movable in the vertical plane further being retained in its vertical path by guides and concurrently held in parallel alignment with the apex of the right hand and left hand structures;

e) said mechanism movable in the vertical plane having a means of restricting movement of the mechanism in an upward or downward vertical direction;

f) said mechanism movable in the vertical plane having a means of supplying force in the upward direction between said mechanism and the right hand and left hand structures;

g) the forward bottom face of each right hand and left hand structure having affixed a swivel wheel, the vertical axis of the swivel wheel being offset and perpendicular from the axis of rotation of the swivel wheel;

h) the rear bottom face of the right hand and left hand structure being joined independently with a cantilevered bogie structure comprised of multiple wheels mounted in-line with the axis of rotation being perpendicular to the mechanism;

i) the rear most bogie wheel of the device having a wheel center of rotation located vertical and beyond the rear most edge of the mechanism movable in the vertical plane of both the right hand and left hand structures;

j) the bogie wheels having such diameters as to allow the bogie structure to move unobstructed under objects of limited clearance between the object's base and the rolling surface;

k) and the bogie structure further having a means for limiting wheel movement to stop or redirect the assistive device.

2. An assistive device as set forth in claim 1:

a) wherein the user receives physical support in walking, standing, sitting and during the act of sitting and standing while maintaining contact with the mechanism coincident to the rear face of the right hand and left hand structures being movable in the vertical plane being retained in its vertical path by guides concurrently held in parallel alignment with the apex of the right hand and left hand structures;

b) the mechanism movable in the vertical plane having a means of restricting movement of the mechanism in the vertical direction;

c) and the mechanism movable in the vertical plane having a means of supplying force in the upward vertical direction.

3. An assistive device as set forth in claim 1:

a) wherein the user of the assistive device being in contact and supported by said mechanism coincident to the rear face of the right hand and left hand structures being movable in the vertical plane further being retained in its vertical path by guides and concurrently held in parallel alignment with the apex of the right hand and left hand structures;

b) the mass of the user being forward of the rear most bogie wheel of the device;

c) the rear most bogie wheel of the device having a wheel center of rotation located vertical and beyond the rear most edge of the mechanism movable in the vertical plane of both the right hand and left hand structures;

d) therein maintaining the device's center of balance under the center of mass of the user.

4. An assistive device as set forth in claim 1:

a) wherein the right hand and left hand structures are held in union with a bearing surface so as to provide rotational movement around the common longitudinal axis of the right hand and left hand structures;

b) the swivel wheel affixed to the forward bottom face of the right hand and left hand structures and the cantilevered bogie structure being joined at the rear bottom face of the right hand and left hand structures concurrently maintain contact with the rolling surface.

5. An assistive device as set forth in claim 1:

a) wherein the left hand and right hand structure are held in union with a bearing surface so as to provide rotational movement around the common longitudinal axis of the right hand and left hand structures;

b) the parallel distance between the right hand and left hand structures is increased or decreased by changes in the thickness of the bearing surfaces around the common longitudinal axis.

6. An assistive device as set forth in claim 1:

a) where in the mechanism coincident to the rear face of the right hand and left hand structures being movable in the vertical plane further being retained in its vertical path by guides and concurrently held in parallel alignment with the apex of the right hand and left hand structures;

b) said mechanism movable in the vertical plane having a means by which the user can maintain contact with the mechanism when the antebrachial region of the user is parallel with the apex of the right hand and left hand structures.

7. An assistive device as set forth in claim 1:

a) where in the mechanism coincident to the rear face of the right hand and left hand structures being movable in the vertical plane further being retained in its vertical path by guides and concurrently held in parallel alignment with the apex of the right hand and left hand structures;

b) said mechanism movable in the vertical plan having a means of providing physical support to the user by making contact with the user in the axilla, anterior and posterior axillary fossa bodily regions;

c) and having a means for adjusting the contact area of the assistive device and the area of the user being supported.

8. An assistive device as set forth in claim 1:

a) wherein the user being supported by the assistive device is free to ambulate in a forward progression or rearward progression;

b) the user can control the direction of his progression by the rotation his upper body in the transverse plane;

c) the directional change being initiated by varying the angle of yaw in the vertical axis of the swivel wheel thereby changing the rotational axis of the swivel wheel.

9. An assistive device as set forth in claim 1:

a) where in the wherein the user can control direction of his progression by limiting the movement of the wheels in either the right hand or left hand structures.

10. An assistive device as set forth in claim 1:

a) where in the user can stop progression of the assistive device by restricting the wheel movement in both the right hand and left hand structures.

* * * * *